US006609905B2

(12) United States Patent
Eroglu et al.

(10) Patent No.: US 6,609,905 B2
(45) Date of Patent: Aug. 26, 2003

(54) CATALYTIC BURNER

(75) Inventors: Adnan Eroglu, Untersiggenthal (CH); Timothy Griffin, Ennetbaden (CH); Jaan Hellat, Baden-Ruetihof (CH)

(73) Assignee: Alstom (Switzerland) Ltd. (CH)

( * ) Notice: Subject to any disclaimer, the term of this patent is extended or adjusted under 35 U.S.C. 154(b) by 0 days.

(21) Appl. No.: 10/132,478

(22) Filed: Apr. 26, 2002

(65) Prior Publication Data

US 2002/0160330 A1 Oct. 31, 2002

Related U.S. Application Data

(60) Provisional application No. 60/286,996, filed on Apr. 30, 2001.

(51) Int. Cl.[7] ..... F23M 3/00; F23Q 11/00; F23Q 9/00

(52) U.S. Cl. ..... 431/284; 431/9; 431/268

(58) Field of Search ..... 431/284, 9, 268, 431/7, 278

(56) References Cited

U.S. PATENT DOCUMENTS

| | | | | |
|---|---|---|---|---|
| 4,081,958 A | | 4/1978 | Schelp | |
| 4,154,568 A | | 5/1979 | Kendall et al. | |
| 5,094,610 A | * | 3/1992 | Mandai et al. | 431/183 |
| 5,202,303 A | | 4/1993 | Retallick et al. | |
| 5,328,359 A | | 7/1994 | Retallick | |
| 5,346,389 A | | 9/1994 | Retallick et al. | |
| 5,350,293 A | * | 9/1994 | Khinkis et al. | 431/116 |
| 5,412,938 A | | 5/1995 | Keller | |
| 5,437,099 A | | 8/1995 | Retallick et al. | |
| 5,634,784 A | * | 6/1997 | Pfefferle et al. | 431/7 |
| 6,048,194 A | | 4/2000 | Pfefferle et al. | |

FOREIGN PATENT DOCUMENTS

| | | |
|---|---|---|
| EP | 0694740 A2 | 1/1996 |
| EP | 0710797 A2 | 5/1996 |
| EP | 0833105 A2 | 4/1998 |
| JP | 61276627 | 12/1986 |
| JP | 2259331 | 10/1990 |
| JP | 4015410 | 1/1992 |
| JP | 06129641 | 5/1994 |

* cited by examiner

*Primary Examiner*—Henry Bennett
*Assistant Examiner*—Alfred Basichas
(74) *Attorney, Agent, or Firm*—Burns, Doane, Swecker & Mathis, LLP

(57) ABSTRACT

The invention relates to a catalytic burner (1) of a combuster (2), in particular of a power station installation, comprising an annular duct (4) leading to the combuster (2), a catalyzer (5) arranged in the annular duct (4), a primary injection device (7) for injecting a fuel into the annular duct (4) upstream of the catalyzer (5), a secondary injection device (3) for directly injecting a fuel into the combuster (2).

To stabilize a recirculation zone (29) in the combuster (2), a swirl generation device (6) is provided, which is arranged in the annular duct (4) downstream of the catalyzer (5) and subjects a flow through the catalyzer (5) to a swirl.

21 Claims, 1 Drawing Sheet

CATALYTIC BURNER

This application claims priority under 35 U.S.C. §119 to U.S. Provisional Application No. 60/286,996 entitled "Swirl Stabilized Catalytic Burner" and filed on Apr. 30, 2001 , the entire content of which is hereby incorporated by reference.

TECHNICAL FIELD

The invention relates to a catalytic burner for or on a combuster of, in particular, a power station installation, having the features of the preamble of claim 1.

PRIOR ART

Such a catalytic burner, which is arranged on a combuster of a gas turbine, is known from JP 61-276 627. The burner has a central, secondary injection device for the direct injection of a fuel into the combuster. The secondary injection device is enclosed by an inner annular duct, which leads to the combuster and in which is arranged a swirler. This swirler surrounds the secondary injection device as an annulus. In addition, an outer annular duct is arranged in the combuster and this likewise leads to the combuster and surrounds, in the form of an annulus, the inner annular duct and, therefore, the secondary injection device. A catalyzer, which surrounds the inner annular duct and therefore also the secondary injection device, is arranged in the outer annular duct. A primary injection device is, furthermore, arranged upstream of the catalyzer in the outer annular duct, and this primary injection device is used for injecting a fuel into the outer annular duct. The known burner is, furthermore, equipped with radially arranged catalyzers and radially arranged injection devices, by means of which a radial flow into the combuster can be realized.

PRESENTATION OF THE INVENTION

The present invention concerns the problem of providing, for a burner of the type mentioned at the beginning, an improved embodiment which, in particular, increases the stability of the combustion in the combuster.

This problem is solved by means of the subject matter of the independent claim. Advantageous embodiments are the subject matter of the dependent claims.

The invention is based on the general idea of configuring the burner in such a way that the flow through the catalyzer has swirl, at least at its entry into the combuster. Subjecting the flow emerging from the catalyzer to a swirl permits support for the formation of a central recirculation zone in the combuster. This recirculation zone leads to the flame front in the combuster being anchored and, therefore, to a stabilization of the combustion process.

A particularly advantageous development is one in which the dimensions of the annular duct and the combuster are matched to one another in such a way that a cross-sectional expansion is configured at the transition from the annular duct to the combuster. By means of this measure, the swirl flow can more or less collapse on entry into the combuster, by which means an additional stabilization is provided for the central recirculation zone.

In this arrangement, a swirl generation device arranged in the annular duct can be expediently positioned directly at the transition between annular duct and combuster. This measure permits the swirl flow to enter the combuster directly after its generation, thus reducing friction losses.

According to an advantageous embodiment, the secondary injection device can be configured for injecting a liquid fuel and for injecting a gaseous fuel, so that the secondary injection device can inject the liquid fuel into the combuster independently of the gaseous fuel. This construction makes it possible to inject gaseous and/or liquid fuel directly into the combuster to suit the requirements under transient operating conditions of the burner, for example in order to achieve a desired temperature in the combuster even when the catalyzer has not yet reached its operating temperature, in particular when running up the burner.

A further special feature may be seen in the fact that a flow path for an oxidant or an oxidant mixture, in particular air and/or the fuel-oxidant mixture, is guided through the burner in such a way that, essentially, the oxidant or the oxidant mixture reaches the combuster through the annular duct only. In this embodiment, the primary injection device and the secondary injection device are arranged in series with respect to this flow path and, therefore, with respect to the oxidant supply. By this means, the oxidant is first available for the catalytic combustion and only subsequently—where present—in the combuster for the reaction with the directly injected fuel. This means that a purely catalyzer burner operation with a relatively high volume flow, in which all the oxidant supplied, usually oxygen, flows through the catalyzer, can be obtained.

Furthermore, an additional reaction zone can be additionally configured in the annular duct upstream of the primary injection device, with which is associated an additional injection device for injecting a fuel or a fuel-oxidant mixture into the additional reaction zone. Such an additional reaction zone permits the achievement of a rapid increase in the temperature of the catalyzer—for starting the burner, for example—so that the catalyzer rapidly achieves its operating temperature.

The use of a suitable control system permits the burner to be switched over, as a function of predetermined parameters, between, for example, a pilot operation, in which the secondary injection device is activated and the primary injection device is deactivated, a catalyzer operation, in which the primary injection device is activated and the secondary injection device is deactivated, and a mixed operation, in which the primary injection device and the secondary injection device are more or less active. By means of the various modes of operation, the burner can be optimally adapted to changing boundary conditions. As an example, the burner can be adapted in this way to a current power demand placed on the burner and/or to requirements with respect to flame stability and pollutant emission and/or to the current temperature of the catalyzer.

Further important features and advantages of the invention are provided by the subclaims, from the drawings and from the associated description of the figures, using the drawings.

BRIEF DESCRIPTION OF THE DRAWINGS

Preferred exemplary embodiments of the invention are represented in the drawings and are explained in more detail in the description below, the same designations referring to the same or functionally equivalent or similar components. Diagrammatically, in each case.

WAYS OF EMBODYING THE INVENTION

Figure 1:
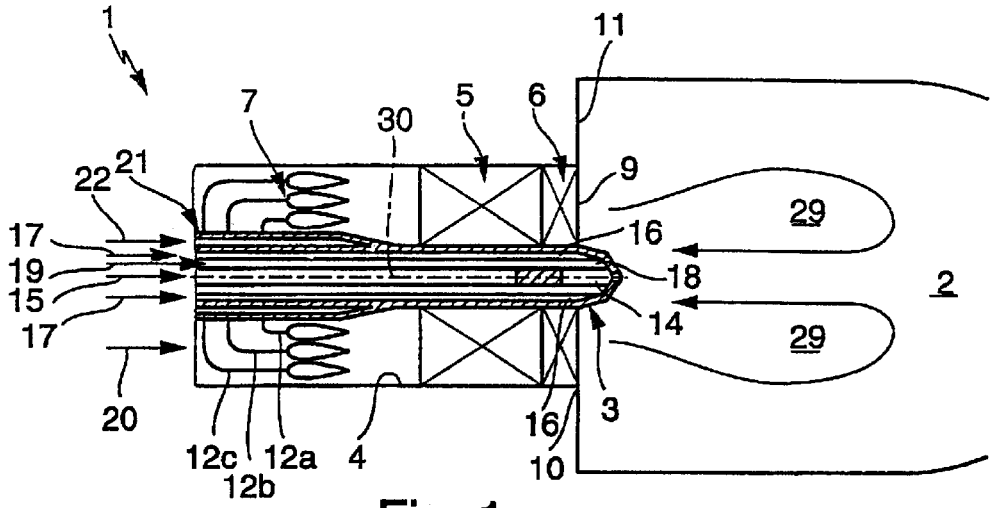
FIGS. 1 to 3 show, in longitudinal section, simplified representations of the principle of a burner according to the invention in various embodiments.
Figure 2:
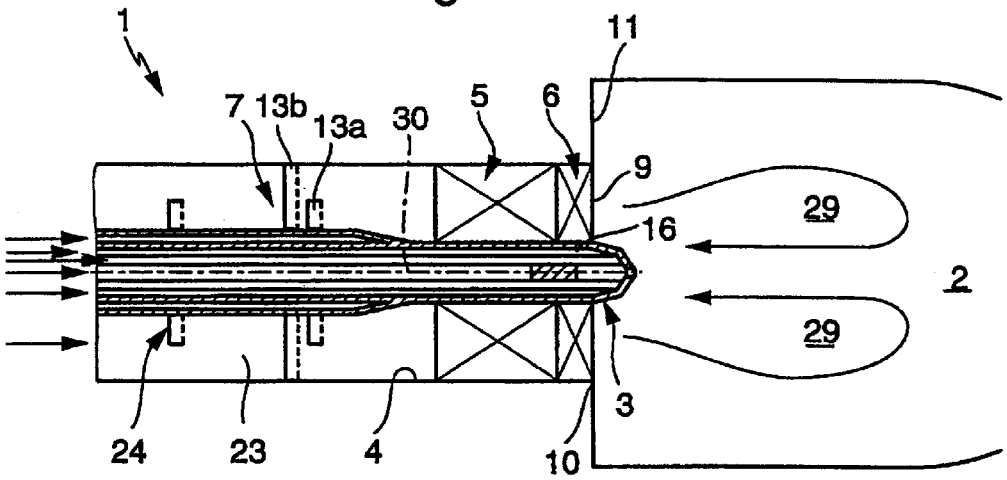
Figure 3:
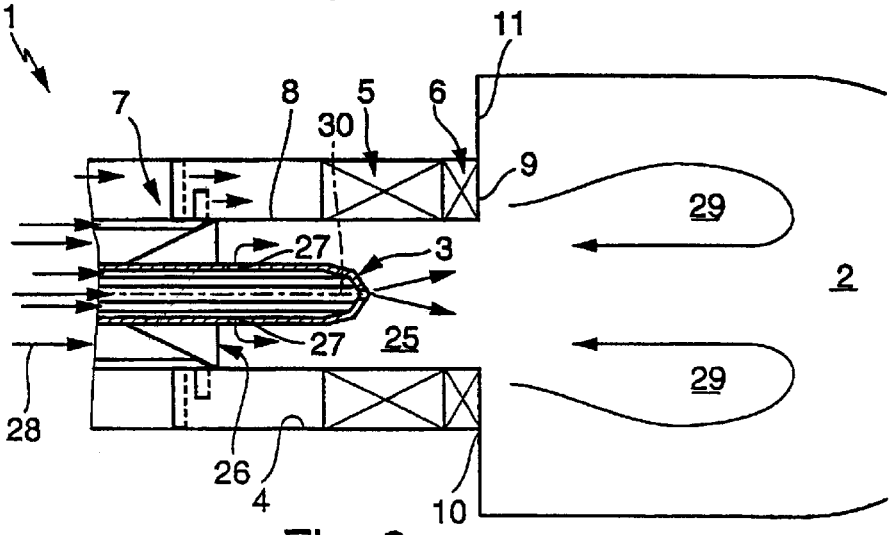

A burner 1 according to the invention is connected to a combuster 2 as shown in FIGS. 1 to 3. The combuster 2 can, in this arrangement, be an annular combuster, silo combuster, cannular combuster or cannular/annular combuster. The burner/combuster combination shown usually forms a constituent part of a power station installation and is used, as a rule, for generating hot exhaust gases which are admitted to a gas turbine.

The burner 1 is equipped with a central, secondary injection device 3, by means of which a fuel can be injected directly into the combuster 2. The secondary injection device 3 is, in this case, arranged coaxially with respect to a central longitudinal center line 30 of an annular duct 4, which leads to the combuster 2 and communicates with the latter. In addition, the annular duct 4 surrounds the secondary injection device 3 as an annulus. An annularly shaped catalyzer 5, which likewise surrounds the secondary injection device 3, is arranged in this annular duct 4. A swirl generation device 6 which, furthermore, likewise surrounds the secondary injection device 3 as an annulus, is arranged downstream of the catalyzer 5 in the annular duct 4. In addition, a primary injection device 7, by means of which a fuel and/or a fuel-oxidant mixture can be injected into the annular duct 4, is arranged upstream of the catalyzer 5 in the annular duct 4.

The secondary injection device 3 does not have to be arranged centrally; an arrangement which is eccentric to the longitudinal center line 30 is likewise possible. The secondary injection device 3 can be configured in such a way that—as in the present case—it introduces the fuel into the combuster 2 centrally and essentially parallel to the longitudinal center line 30. Additionally, or alternatively, the secondary injection device 3 can also be designed in such a way that it introduces the fuel into the combuster 2 transversely or inclined to the longitudinal center line 30 and/or laterally.

The catalyzer 5 can, for example, be configured as a ceramic monolith which is coated with a catalytically acting substance. It is likewise possible to build up the catalyzer 5 by appropriate layering or stacking of one or a plurality of folded or corrugated sheets, ducts which penetrate the catalyzer 5 arising from a corresponding orientation of the folds and corrugations. Catalytically active ducts and catalytically inactive ducts can be configured by suitable coating of the sheets with a catalytically active material. Catalyzers which are built up in this way are known, for example, from U.S. Pat. No. 5,202,303. In the embodiments of FIGS. 1 and 2, the catalyzer 5 can be formed by a helical winding of one or a plurality of appropriate sheets, which are expediently wound onto the secondary injection device 3. In the embodiment shown in FIG. 3, the sheets can be wound onto a tube 8 in order to form the catalyzer 5, this tube 8 forming the radially inward boundary of the annular duct 4.

The swirl generation device 6 subjects the flow through the catalyzer 5 to a swirl. In this arrangement, the swirl generation device 6 can, as in this case, have a swirler 9, which forms a separate component. As a variant from this, it is likewise possible to integrate the swirl generation device 6 into the catalyzer 5. As an example, the flow guidance ducts configured in the catalyzer 5 can be inclined relative to the center line direction of the catalyzer 5, particularly in an axial end section of the catalyzer 5, in order to generate the swirl.

It is, furthermore, of particular importance for the swirl generation device 6 to be arranged directly at a transition 10, at which the annular duct 4 merges into or opens into the combuster 2. In the embodiments shown in the present case, this transition 10 is designed in such a way that it forms an abrupt cross-sectional expansion 11. The swirling due to the swirl generation device 6, the arrangement of the swirl generation device 6 directly at the transition 10 and the cross-sectional expansion 11 at the transition 10 support the formation of a central recirculation zone 29 in the combuster 2 and ensure stabilization of this recirculation zone 29, which permits a stable flame front to be achieved in the combuster 2.

In the embodiments shown in this case, the primary injection device 7 is configured in a plurality of stages, i.e. the primary injection device 7 has a plurality of injection stages 12*a*, 12*b*, 12*c*, as shown in FIGS. 1 and 13*a*, 13*b* as shown in FIGS. 2 and 3. In the embodiment shown in FIG. 1, injection nozzles (not shown in any more detail) to 12*c* are arranged at each injection stage 12*a* in the annular duct with a concentric distribution and in a ring shape relative to the longitudinal center line 30 and relative to the secondary injection device 3. In the case of the embodiments of FIGS. 2 and 3, in contrast, the injection nozzles at the injection stages 13*a* and 13*b* are arranged concentrically and with a star-shaped distribution with respect to the longitudinal center line 30 and with respect to the secondary injection device 3.

In this connection, the ability to configure the primary injection device 7 for the injection of a fuel-oxidant mixture is of particular importance. In contrast to this, the secondary injection device 3 is configured, in the case of the embodiments shown here, for injecting both a liquid fuel and a gaseous fuel. For this purpose, the secondary injection device 3 includes a central first injection arrangement 14, which is supplied with liquid fuel, as shown by an arrow 15. In addition, the secondary injection device 3 includes a second injection arrangement 16, which is supplied with gaseous fuel, as shown by an arrow 17. By means of an appropriate fuel control system (not shown here), these injection arrangements 14 and 16 can be actuated independently of one another in order to inject either liquid fuel or gaseous fuel, or both liquid and gaseous fuel, into the combuster 2. In this arrangement, the secondary injection device 3 is expediently configured in such a way that it can inject the liquid fuel, at least, into the central recirculation zone 29.

In the embodiment shown here, the second injection arrangement surrounds the central first injection arrangement 14 as an annulus. In order to avoid overheating, an annular cooling duct 18 is arranged between the injection arrangements 14 and 16 and a cooling gas, for example air, flows through this duct 18, as shown by an arrow 19.

A gas flow is supplied to the annular duct 4, as shown by an arrow 20, the gas generally being air. When flowing through the burner 1, this air follows a flow path (not shown in any more detail) which leads from the annular duct 4, through the catalyzer 5 and through the swirl generation device 6 into the combuster 2. In this arrangement, it is important that the supply of air or of the oxidant mixture takes place exclusively via this flow path, apart from parasitic effects occurring due, for example, to the cooling gas flow through the cooling duct 18. This construction has the result that the total oxidant flow must first flow through the catalyzer 5 before it reaches the combuster 2 and before it comes into contact with the fuel which may be injected via the secondary injection device 3. To this extent, the secondary injection device 3 is connected in series downstream of the primary injection device 7.

In the embodiments of FIGS. 1 and 2, at least, the secondary injection device 3 and the primary injection device 7 are connected to a common fuel supply device 21 for supplying the two injection devices 3 and 7 with fuel or fuel-oxidant mixture. The supply of the fuel or fuel mixture injected via the primary injection device 7 is symbolized by an arrow 22.

In the embodiment shown in FIG. 2, an additional annular reaction zone 23, which concentrically encloses the secondary injection device 3 and the longitudinal center line 30, is additionally configured upstream of the primary injection device 7. An additional injection device 24, by means of which fuel or a fuel-oxidant mixture can be injected into the additional reaction zone 23, is associated with this additional reaction zone 23. A combustion reaction can therefore be initiated in the additional reaction zone 23, during which hot exhaust gases occur which flow through the catalyzer, heating it in the process.

In the embodiment shown in FIG. 3, the tube 8 separates the annular duct 4 from a central, inner duct 25, in which the secondary injection device 3 is arranged, preferably concentrically. A swirler 26, which is expediently positioned upstream of injection orifices of the secondary injection device 3, is arranged in this duct 25. In this embodiment, the secondary injection device 3 can have additional radial injection orifices 27, by means of which gaseous fuel can be injected into the inner duct 25. The inner duct 25 is open toward the combuster 2 and is likewise used for introducing a gas flow. This gas flow, in particular air, is guided into the inner duct 25, as shown by an arrow 28, this flow being subjected to a swirl by the swirler 26. This inner swirl flow can also be used for stabilizing the recirculation zone 29.

A burner control system (not shown here) can now, as a function of parameters, realize a pilot operation, a catalyzer operation and a mixed operation for the burner 1. In the case of pure pilot operation, the secondary injection device 3 is activated, whereas the primary injection device 7 is deactivated. Additionally or alternatively, the additional injection device 24 can be activated in pilot operation. In contrast to this, the primary injection device 7 is activated in the case of pure catalyzer operation, whereas the secondary injection device 3 is deactivated. In the case of mixed operation, both the primary injection device 7 and the secondary injection device 3 are activated. The parameters, as a function of which the burner control system switches between the individual operating modes, can comprise at least one of the following parameters: a power demand currently made on the burner 1 and/or requirements with respect to flame stability and pollutant emission and/or current temperature of the catalyzer 5.

List of Designations

1 Burner
2 Combuster
3 Secondary injection device
4 Annular duct
5 Catalyzer
6 Swirl generation device
7 Primary injection device
8 Tube
9 Swirler
10 Transition between 4 and 2
11 Cross-sectional expansion
12*a* Injection stage
12*b* Injection stage
12*c* Injection stage
13*a* Injection stage
13*b* Injection stage
14 First injection arrangement
15 Supply of liquid fuel
16 Second injection arrangement
17 Supply of gaseous fuel
18 Cooling duct
19 Supply of cooling gas
20 Supply of gas
21 Fuel supply device
22 Supply of fuel-oxidant mixture
23 Additional reaction zone
24 Additional injection device
25 Inner duct
26 Swirler
27 Radial injection orifice
28 Supply of gas
29 Central recirculation zone
30 Longitudinal center line

What is claimed is:

1. A catalytic burner on or for a combuster, in particular of a power station installation, comprising an annular duct leading to the combuster, a catalyzer arranged in the annular duct, a primary injection device for injecting a fuel and/or a fuel-oxidant mixture into the annular duct upstream of the catalyzer.

a secondary injection device for directly injecting a fuel into the combuster, wherein a swirl generation device is provided, which is arranged in the annular duct downstream of the catalyzer and subjects a flow through the catalyzer to a swirl.

2. The burner as claimed in claim 1, wherein the secondary injection device is configured in such a way that it injects fuel or fuel-oxidant mixture into a recirculation zone, which forms in the combuster during operation of the burner.

3. The burner as claimed in claim 1, wherein the secondary injection device is arranged relative to the annular duct in such a way that the annular duct and the catalyzer surround the secondary injection device as an annulus.

4. The burner as claimed in claim 1, wherein the secondary injection device is arranged concentrically or eccentrically with respect to a central longitudinal center line of the annular duct.

5. The burner as claimed in claim 1, wherein the swirl generation device is integrated into the catalyzer.

6. The burner as claimed in claim 1, wherein the swirl generation device has a swirler, which is configured as a separate component and is arranged downstream of the catalyzer in the annular duct.

7. The burner as claimed in claim 1, wherein the dimensions of the annular duct and the combuster are adapted to one another in such a way that a cross-sectional expansion is configured at the transition from the annular duct to the combuster.

8. The burner as claimed in claim 1, wherein the swirl generation device is arranged at the transition between the annular duct and the combuster.

9. The burner as claimed in claim 1, wherein the primary injection device has a plurality of injection stages, which can be actuated independently of one another for injecting the fuel or the fuel-oxidant mixture into the annular duct.

10. The burner as claimed in claim 1, wherein the primary injection device has a plurality of injection nozzles, which are arranged in the annular duct concentrically and in a ring or star shape relative to a central longitudinal center line of the annular duct.

11. The burner as claimed in claim 9, wherein each injection stage has a plurality of injection nozzles, which are arranged in the annular duct concentrically and in a ring or star shape wit respect to the central longitudinal center line of the annular duct.

12. The burner as claimed in claim 1, wherein the secondary injection device and the primary injection device are connected, for the supply with fuel and/or fuel-oxidant mixture, to a common fuel supply device.

13. The burner as claimed in claim 1, wherein the secondary injection device has a first injection arrangement supplied wit liquid fuel and second injection arrangement supplied with gaseous fuel, which arrangements can be actuated independently of one another.

14. The burner as claimed in claim 1, wherein a flow path for an oxidant or an oxidant mixture, in particular air and/or fuel-oxidant mixture, is guided through the burner in such a way tat the oxidant or the oxidant mixture essentially reaches the combuster through the annular duct only.

15. The burner as claimed in claim 1, wherein the annular duct encloses a central, inner duct which is open toward the combuster.

16. The burner as claimed in claim 15, wherein the secondary injection device is arranged in the central, inner duct.

17. The burner as claimed in claim 16, wherein a swirler is provided which is arranged in the inner duct upstream of one or a plurality of injection orifices of the secondary injection device and subjects a flow through the inner duct to a swirl.

18. The burner as claimed in claim 1, wherein an additional reaction zone is configured in the annular duct upstream of the primary injection device, with which additional reaction zone is associated an additional injection device for injecting a fuel or a fuel-oxidant mixture into the additional reaction zone.

19. The burner as claimed in claim 1, wherein the primary injection device is configured for injecting a fuel-oxidant mixture.

20. The burner as claimed in claim 1, wherein a burner control system is provided which, as a function of predetermined parameters, permits, for the burner, a pilot operation with activated secondary injection device and deactivated primary injection device, a catalyzer operation with activated primary injection device and deactivated secondary injection device and a mixed operation with activated primary injection device and activated secondary injection device.

21. The burner as claimed in claim 20, wherein the predetermined parameters comprise at least one of:

a current power requirement placed on the burner, requirements with respect to flame stability and pollutant emission, and temperature of the catalyzer.

* * * * *